US009127429B2

(12) United States Patent
Pateuk

(10) Patent No.: US 9,127,429 B2
(45) Date of Patent: Sep. 8, 2015

(54) DEVICE FOR SUPPORTING THE WALLS OF AN EXCAVATION

(71) Applicant: John David Pateuk, Millis, MA (US)

(72) Inventor: John David Pateuk, Millis, MA (US)

( * ) Notice: Subject to any disclaimer, the term of this patent is extended or adjusted under 35 U.S.C. 154(b) by 0 days.

(21) Appl. No.: 13/657,911

(22) Filed: Oct. 23, 2012

(65) Prior Publication Data

US 2014/0112726 A1 Apr. 24, 2014

(51) Int. Cl.
*E02D 17/00* (2006.01)
*E02D 17/08* (2006.01)

(52) U.S. Cl.
CPC ..... *E02D 17/08* (2013.01)

(58) Field of Classification Search
CPC ..... E02D 29/02; E02D 29/025; E02D 17/08; E02D 17/04; E04B 9/0414
USPC ..... 405/282, 283, 272, 284
See application file for complete search history.

(56) References Cited

U.S. PATENT DOCUMENTS 2,922,283 A * 1/1960 Porter ..... 405/283
3,782,126 A * 1/1974 Pavese ..... 405/282
4,235,145 A * 11/1980 Adams, Jr. ..... 84/293
5,533,838 A 7/1996 Kundel
5,669,738 A 9/1997 Kundel
6,443,665 B1 9/2002 Kundel, Sr.
7,402,003 B2 7/2008 Kundel, Sr.
7,611,308 B1 11/2009 Kundel, Sr.
7,661,908 B1 2/2010 Kundel, Sr.
7,837,413 B1 11/2010 Kundel, Sr.
8,151,463 B1 4/2012 Kundel, Sr.

* cited by examiner

*Primary Examiner* — Doug Hutton, Jr.
*Assistant Examiner* — Patrick Lambe
(74) *Attorney, Agent, or Firm* — Kriegsman & Kriegsman

(57) ABSTRACT

A device for supporting the walls of an excavation includes first and second opposing support panels that are spaced apart from one another by front and rear pairs of laterally extending separation members. Each support panel includes an outwardly bowed skin plate and a plurality of horizontal and vertical members secured to the inner surface of the skin plate for structural support. Each support panel additionally includes an inwardly bowed truss strap that is secured to the inner surface of the skin plate at its ends. In use, the truss strap serves to convert radial forces applied to the outer surface of the skin plate into tensile forces extending along the length of the strap. Accordingly, the outward radial curvature of the skin plate and the inclusion of the truss strap together serve to minimize the risk of panel deformation during use.

10 Claims, 11 Drawing Sheets

DEVICE FOR SUPPORTING THE WALLS OF AN EXCAVATION

FIELD OF THE INVENTION

The present invention relates generally to the construction industry and more particularly to safety equipment for supporting the walls of an excavation, such as a trench.

BACKGROUND OF THE INVENTION

In the construction industry, excavations of various types, such as foundations, trenches and the like, are formed in the ground. For example, a trench is often excavated in soil in order to provide access to underground conduits, such as water and sewage pipes, that in turn require maintenance, replacement and/or installation.

Due to unstable soil conditions, improper sloping of an excavation and/or other unaccounted for occurrences, the sidewalls of an excavation can loosen and subsequently collapse. The collapse of an excavation sidewall can result in the destruction of equipment, a delay in job completion and, most seriously, injury or death to professionals who are working within the excavation during the collapse. In response thereto, the Occupational Safety and Health Administration (OSHA) has recognized excavations as extremely hazardous construction operations and, as a result, has promulgated regulations directed to the manner in which excavations are created and to the structures used to support excavations to prevent sidewall collapse.

A trench box one well-known piece of shielding, or shoring, equipment that is commonly used in the construction industry to support the two principal walls of a trench or similar excavation. A trench box is commonly constructed using a pair of enlarged, rigid, metal support panels that are spaced apart and arranged substantially in parallel by a plurality of laterally extending, tubular separation members, which are commonly referred to in the art as spreader bars.

In use, a trench is excavated in the soil to permit access to a particular conduit. The trench box is then driven vertically downward into the trench with the opposing outer panels disposed on opposite sides of the conduit and ultimately in firm contact against the main trench walls, this vertical displacement step being referred to herein simply as the "drive mode." Positioned in this manner, the planar panels provide a shoring or shielding function by holding the sidewalls of the excavation in place, thereby preventing the sidewalls from collapsing into the trench. With the trench box disposed in place, construction professionals are able to further excavate the trench and readily access a particular section of the conduit through its open top end without the risk of sidewall collapse.

Once treatment of the particular section of the conduit is completed, the trench box is typically dragged longitudinally within the trench to allow for further excavation as well as the similar treatment of adjacent sections of the conduit, this longitudinal displacement step being referred to herein as the "slide mode." By drawing the trench box longitudinally within the trench in defined increments, or stages, multiple sections of a conduit can be sequentially accessed and treated in a safe manner.

One type of trench box which is well known and widely used in commerce utilizes a pair of enlarged panels that are generally planar in shape. Each panel is typically constructed using a thin, rectangular, steel skin plate that has flattened inner and outer surfaces. A plurality of longitudinal tubular members, often U-shaped or L-shaped in transverse cross-section, is welded onto the inner surface of the skin plate to provide strength, stiffness and structural rigidity to the panel. The longitudinal members are disposed horizontally in a parallel relationship with adjacent members often separated by hollow spacers or channel-like gaps in order to reduce material costs and overall weight. To provide further strength to the panel, a plurality of vertical stiffening members, or stiffeners, is typically welded to the inner surface of the skin plate in a spaced apart relationship. It is to be understood that the longitudinal and vertical members preferably share a common thickness and thereby provide each planar panel with flattened interior and exterior walls that extend in parallel.

For example, in U.S. Pat. No. 7,611,308 to R. Kundel, Sr., the disclosure of which is incorporated by reference, there is provided a panel for supporting the sidewalls of an excavation that includes a plate, longitudinal members and vertical members. Each longitudinal member includes a first leg extending along the length, substantially parallel to and spaced laterally from the plate. The first leg of each longitudinal member is located adjacent and secured to the first leg of another member. A second leg, integral with the first leg, extends along the length, away from the first leg and toward the plate, the second leg being secured to the plate. Axially spaced vertical members are welded to the plate and to the longitudinal members.

Although well-known and widely used in art, trench boxes of the type described above, which rely upon a panel construction that features longitudinal and vertical tubular members that are welded onto the inner surface of a common skin plate, have been found to suffer from a couple notable drawbacks.

As a first drawback, it has been found that trench boxes of the type as described above that utilize planar panels with flattened interior and exterior walls are relatively difficult to move within a trench during either its drive phase or its slide phase. Specifically, the planar construction of each panel maximizes the surface area of the panel that is exposed for contact with the soil during displacement of the trench box. As a result of the increased surface area, the frictional forces imparted onto each panel are similarly increased. Accordingly, the speed in which the trench box can be properly positioned within the trench is limited, thereby resulting in decreased productivity, which is highly undesirable.

As a second drawback, it has been found that trench boxes of the type as described above are incapable of adequately withstanding significant inward lateral forces. In particular, it has been found that each panel tends to inwardly distort, or bow, in response to the considerable lateral load applied thereto by certain types of trench walls (e.g., trench walls formed at a considerable depth and/or with limited soil stability). This permanent inward curvature, or bowing, of the panels renders the distorted trench box considerably difficult to drag longitudinally through a trench during its slide mode. More specifically, the inward bowing of the panels substantially increases the frictional forces imparted on the trench box during its slide mode, thereby resulting in decreased productivity, which is highly undesirable.

BRIEF SUMMARY OF THE INVENTION

It is an object of the present invention to provide a new and improved device for supporting the walls of an excavation, such as a trench.

It is another object of the present invention to provide a device as described above that includes a pair of enlarged support panels separated by one or more spreader bars.

It is yet another object of the present invention to provide a device as described above wherein each support panel is designed to withstand considerable lateral loads without distortion or failure.

It is still another object of the present invention to provide a device as described above that is optimally configured to limit frictional forces imparted thereon during displacement within the excavation.

It is yet still another object of the present invention to provide a device as described above that is lightweight, durable, easy to use, and inexpensive to manufacture.

Accordingly, as a principal feature of the present invention, there is provided a device for device for supporting the walls of an excavation, the device comprising (a) first and second opposing support panels that are spaced apart from one another, each of the first and second support panels having an exterior wall, an interior wall, a top wall, a bottom wall, a front end wall and a rear end wall, and (b) a separation member extending laterally between the first and second support panels, the separation member having a first end and a second end, (c) wherein the first support panel comprises a truss strap, whereby radial forces applied to the exterior wall of the first support panel are converted into tensile forces applied to the truss strap.

As another feature of the present invention, there is provided A device for supporting the walls of an excavation, the device comprising (a) first and second opposing support panels that are spaced apart from one another, each of the first and second support panels having an exterior wall, an interior wall, a top wall, a bottom wall, a front end wall and a rear end wall, and (b) a separation member extending laterally between the first and second support panels, the separation member having a first end and a second end, (c) wherein the exterior wall of the support panel is non-planar.

As another feature of the present invention, there is provided a device for supporting the walls of an excavation, the device comprising (a) first and second opposing support panels that are spaced apart from one another, each of the first and second support panels having an exterior wall, an interior wall, a top wall, a bottom wall, a front end wall and a rear end wall, each of the first and second support panels comprising a collar that extends orthogonally out from its interior wall, the collar being shaped to define first and second transverse openings at distinct points along its length, (b) a separation member extending laterally between the first and second support panels, the separation member having a first end coupled to the collar on the first support panel and a second end coupled to the collar on the second support panel, the separation member being shaped to include a transverse opening at each of its first and second ends, wherein the separation member is adapted for displacement relative to each collar so that the opening in each separation member selectively aligns with each of the first and second openings in its corresponding collar, and (c) a fastening element dimensioned for insertion through each opening in the separation member and the opening in the collar in alignment with the opening in the separation member.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 14(*b*) is a front view of the support panel shown in FIG. 2(*a*);

FIG. 14(*c*) is an enlarged, fragmentary, left end perspective view of the support panel shown in FIG. 2(*a*);

FIG. 15(*b*) is a section view of the collar shown in FIG. 15(*a*), taken along lines 15B-15B;

FIG. 15(*c*) is a section view of the collar shown in FIG. 15(*a*), taken along lines 15C-15C;

DETAILED DESCRIPTION OF THE INVENTION

Figure 1A:
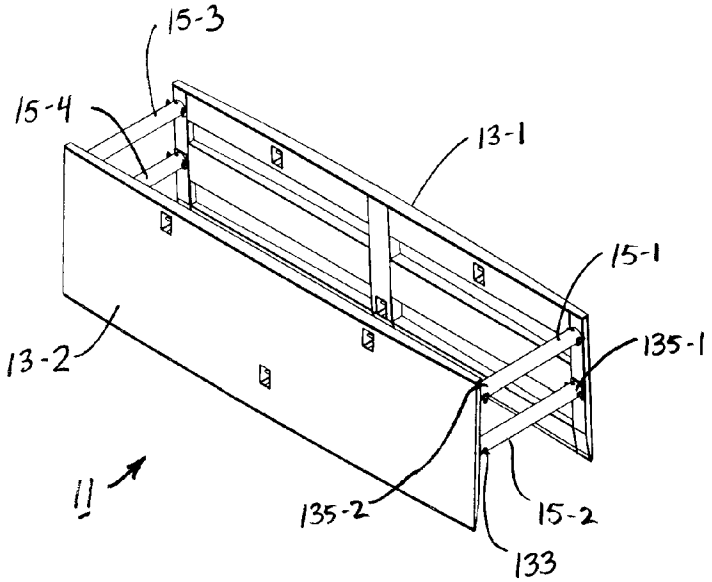
FIGS. 1(*a*)-(*d*) are top perspective, front, left end, and top views, respectively, of a device for supporting the walls of an excavation, the device being constructed according to the teachings of the present invention.
Figure 1B:
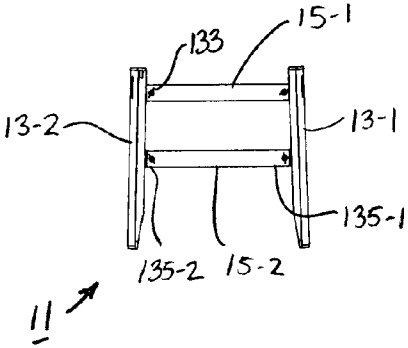
Figure 1C:
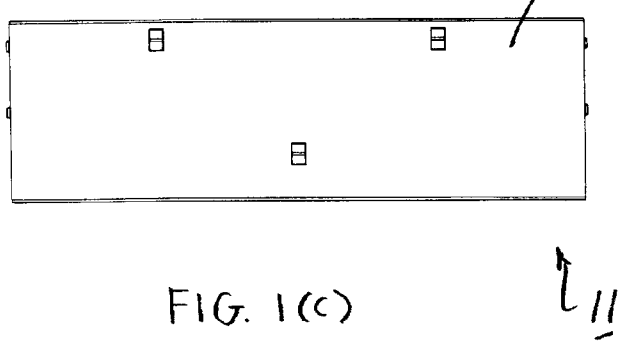
Figure 1D:
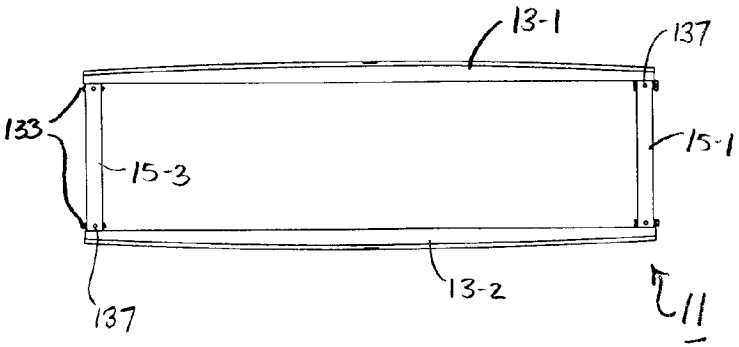

Referring now to FIGS. 1(*a*)-(*d*), there is shown a device for supporting the walls of an excavation, the device being constructed according to the teachings of the present invention and identified generally by reference numeral 11. As will be described in detail below, device 11 is specifically designed to (i) withstand considerable lateral loads without failure or distortion, and (ii) allow for displacement within an excavation with limited frictional forces imparted thereon, which are principal objects of the present invention.

For simplicity purposes only, device 11 is described herein for use in supporting the walls of a trench formed in soil. However, it should be noted that device 11 is not limited to use within any particular type of excavation. Rather, device 11 could be utilized in any type of man-made cut, cavity, trench or depression in the ground that is formed through the removal of earth.

As seen most clearly in FIGS. 1(*a*)-(*d*), device 11 comprises a pair of identically constructed, upstanding support panels 13-1 and 13-2 that are designed to abut firmly against and support the opposing walls of a trench, each panel 13 being of a height that roughly corresponds to the intended depth of the excavation. Panels 13 are disposed as mirror reflections of one another and are maintained in a spaced apart, generally parallel relationship by a plurality of laterally extending separation members 15-1 thru 15-4, each member 15 being secured at opposite axial ends to panels 13-1 and 13-2.

Figure 2A:
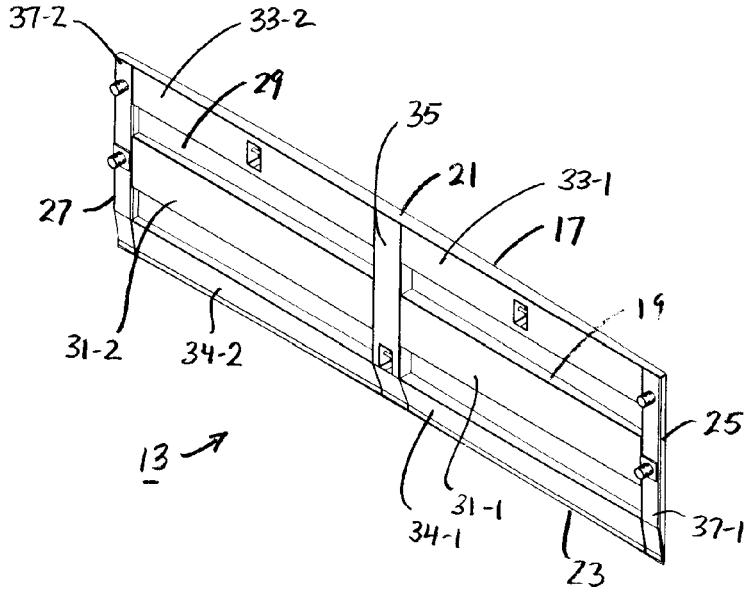
FIGS. 2(*a*)-(*b*) are left end perspective and left end views, respectively, one of the support panels shown in FIG. 1.
Figure 2B:
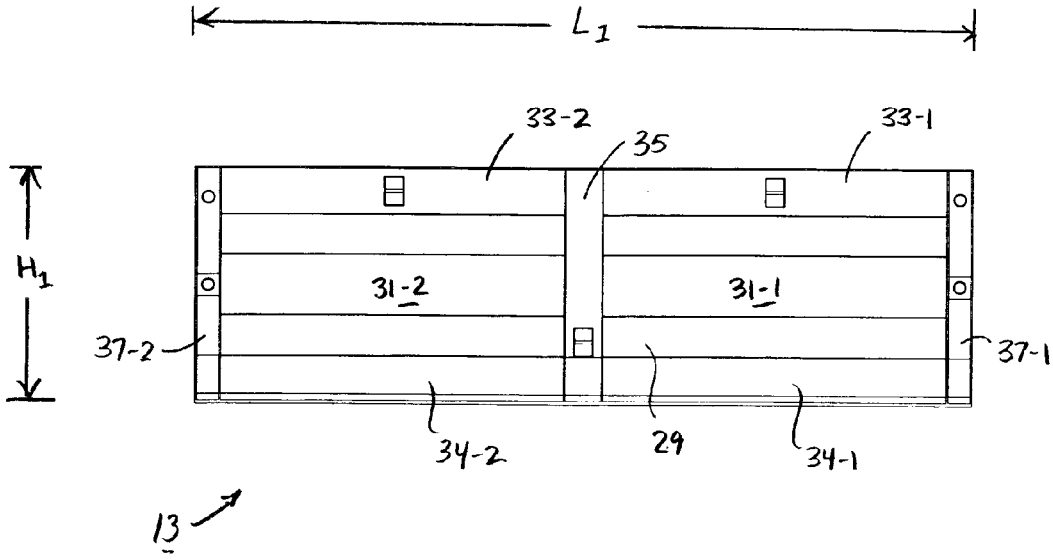

Referring now to FIGS. 2(*a*) and 2(*b*), each upstanding support panel 13 is constructed as a rigid, durable and lightweight component that includes an outwardly bowed exterior wall 17, a generally flat interior wall 19, a thin top wall 21, a thin bottom wall 23 that tapers into a narrow knife edge, a front end wall 25 and a rear end wall 27. In the present embodiment, each panel 13 is generally rectangular in shape, with a length $L_1$ of approximately 20 feet and a height $H_1$ of approximately 6 feet. However, it is to be understood that the relative dimensions of each panel 13 could be modified to meet the needs of different applications without departing from the spirit of the present invention.

Each panel 13 includes a skin plate 29, a pair of center horizontal members 31-1 and 31-2 mounted onto skin plate 29 in spaced apart, coaxial alignment, a pair of top horizontal members 33-1 and 33-2 mounted onto skin plate 29 in spaced apart, coaxial alignment, a pair of bottom horizontal members 34-1 and 34-2 mounted onto skin plate in a spaced apart, coaxial alignment, a center vertical member 35 mounted onto skin plate 29 between each pair of members 31, 33 and 34, and a pair of opposing vertical end members 37-1 and 37-2 mounted onto skin plate 29, the function of members 31, 33, 34, 35 and 37 to become apparent below.

Figure 3A:
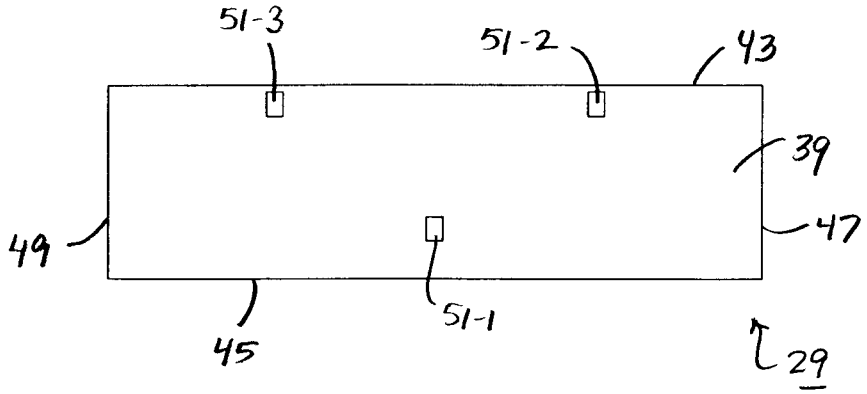
FIGS. 3(*a*)-(*b*) are left end and top views, respectively, of the skin plate shown in FIG. 2(*b*)
Figure 3B:
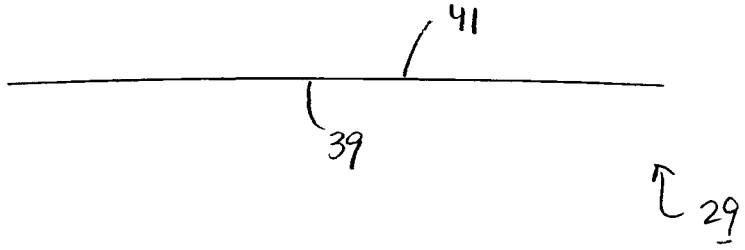
Figure 4C:
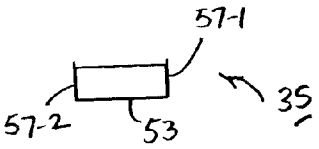
FIGS. 4(*a*)-(*c*) are left end, front and top views, respectively, of the center vertical member shown in FIG. 2(*a*)
Figure 4A:
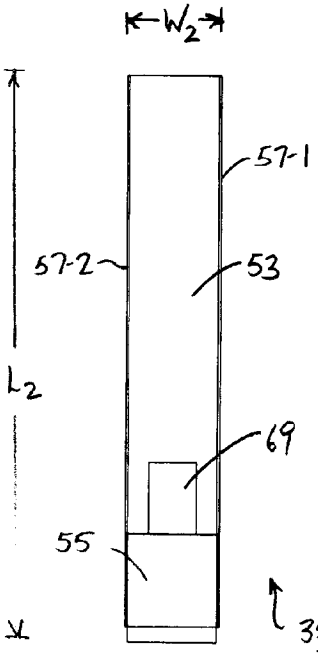
Figure 4B:
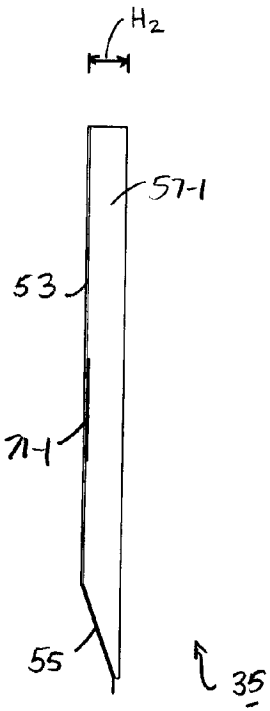

Skin plate 29, shown in isolation in FIG. 3(*a*)-(*b*), is constructed as a thin, unitary sheet of grade 50 steel, approximately 20 feet in length and approximately 6 feet in height, skin plate 29 including an inner surface 39, an outer surface 41, a top edge 43, a bottom edge 45, a front edge 47 and a rear edge 49. In addition, skin plate 29 is shaped to define a plurality of rectangular openings 51-1 thru 51-3 that extend transversely therethrough, the function of openings 51 to become apparent below.

As seen most clearly in FIG. 3(*b*), skin plate 29 has a slight outward radial curvature. This outward curvature of skin plate 29, in turn, provides an external radius of approximately 2,874.205 inches to each panel 13, as seen most clearly in FIG. 1(*d*). It should be noted that the presence of an external radius enables each panel 13 to more adequately absorb inward lateral forces applied at a generally right angle relative to outer surface 41 by the trench wall as well as to limit the frictional forces applied thereto during displacement of device 11 within a trench.

Referring now to FIGS. 2(*a*) and 4(*a*)-(*c*), center vertical member 35 has an elongated tubular configuration that is generally U-shaped in transverse cross-section, with a length $L_2$ of approximately 71.88 inches, a width $W_2$ of approximately 12.0 inches, and a height $H_2$ of approximately 5.0 inches. As can be seen, center vertical member 35 includes a flattened base 53, an angled bottom wall 55 and a pair of upstanding sidewalls 57-1 and 57-2, the free end of each sidewall 57 being welded, or otherwise permanently affixed, to inner surface 39 of skin plate 29. As will be described further below, angled bottom wall 55 assists in providing thin bottom wall 23 of panel 13 with its narrow taper.

Figure 5A:
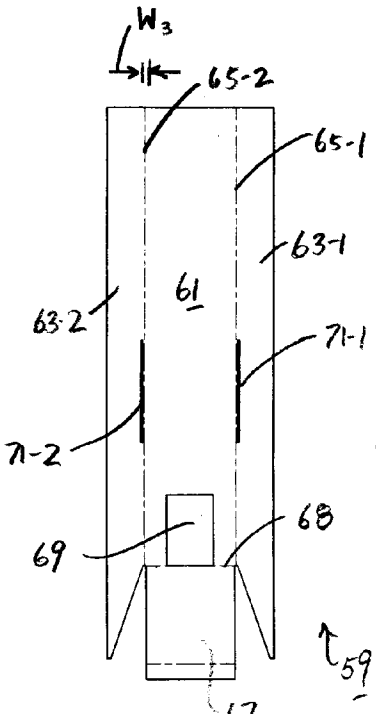
FIGS. 5(*a*)-(*b*) are left end and enlarged, fragmentary, left end views, respectively, of a blank for constructing the center vertical member shown in FIG. 2(*a*)
Figure 5B:
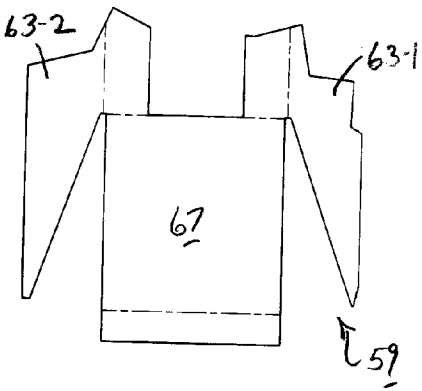

As seen most clearly in FIGS. 5(*a*)-(*b*), center vertical member 35 is preferably formed from a unitary blank 59 that is constructed out of 50 grade steel. As can be seen, blank 59 includes an upper central section 61, first and second outer sections 63-1 and 63-2 joined to opposing side edges of section 61 by fold lines 65-1 and 65-2, respectively, and a lower central section 67 jointed to bottom edge of section 61 by fold line 68. With blank 59 properly folded along lines 65 and 68, upper central section 61 corresponds to base 53, outer sections 63-1 and 63-2 correspond to sidewalls 57-1 and 57-2, respectively, and lower central section 67 corresponds to angled bottom wall 55.

Center vertical member 35 is shaped to define a narrow, rectangular, transverse opening 69 in base 53 that directly aligns with opening 51-1 in skin plate 29. In addition, center vertical member 35 is shaped to define a pair of narrow lateral slots 71-1 and 71-2 formed into a length of fold lines 65-1 and 65-2, respectively, each slot 71 having a length $L_3$ of approximately 12.81 inches and a width $W_3$ of approximately 0.25 inches.

Figure 6:
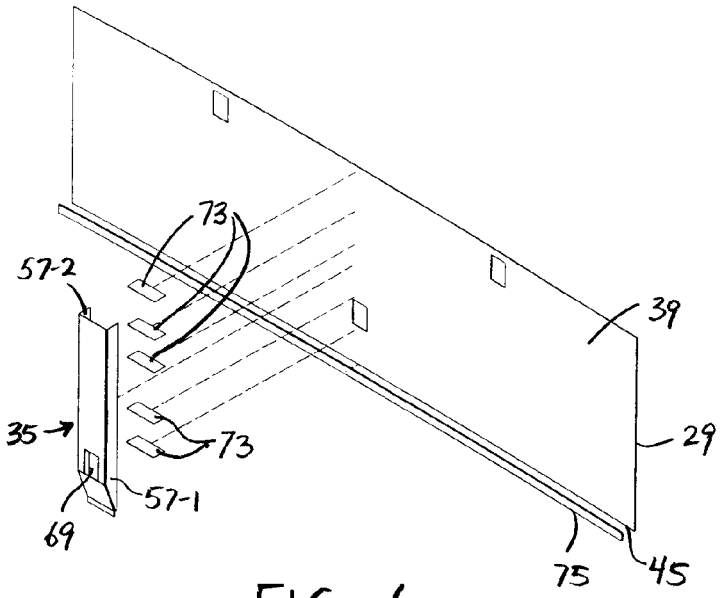
FIG. 6 is an exploded left end perspective view of the center vertical member, skin plate, cutting bar and reinforcement tabs for the support panel shown in FIG. 2(*a*)

Referring now to FIG. 6, each sidewall 57 for center vertical member 35 is welded, or otherwise affixed, to inner surface 39 of skin plate 29, as noted briefly above. A plurality of thin, rectangular reinforcement tabs 73 are preferably fittingly disposed between base 53 and skin plate 29 in a spaced apart, horizontal arrangement to provide structural rigidity and strength to center vertical member 35. In addition, a thin longitudinal cutting bar 75 of 50 grade steel is permanently secured to inner surface 39 of skin plate 29 along the entirety of bottom edge 45, the length and curvature of cutting bar 75 being preferably identical to skin plate 29. As can be appreciated, cutting bar 75 facilitates driving panel 13 vertically downward into soil.

Figure 7:
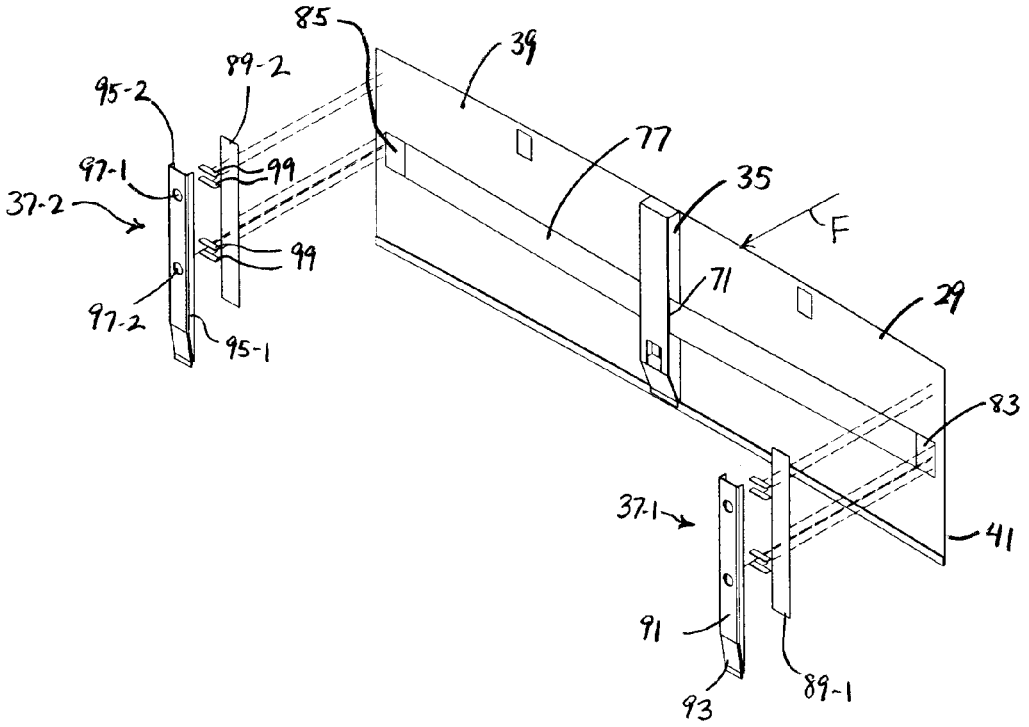
FIG. 7 is a partially exploded, left end perspective view of the skin plate, center vertical member, cutting bar, truss strap, vertical end members, end post back plates and collar reinforcement tabs for the support panel shown in FIG. 2(*a*)

As shown in FIG. 7, an internal truss, or tension, strap 77 is coupled to skin plate 29 in order to absorb inward lateral forces applied to outer surface 41, as represented by arrow F, and thereby minimize the risk of deformation of panel 13. For this reason, the inclusion of tension strap 77 in panel 13 serves as a principal novel feature of the present invention.

Figure 8A:
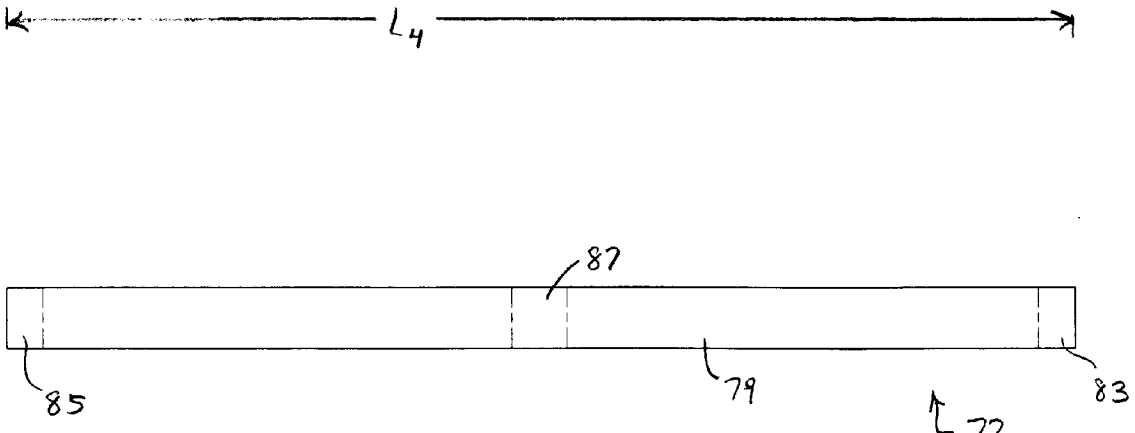
FIGS. 8(*a*)-(*c*) are left end, top and front end views, respectively, of the truss strap shown in FIG. 7.
Figure 8B:
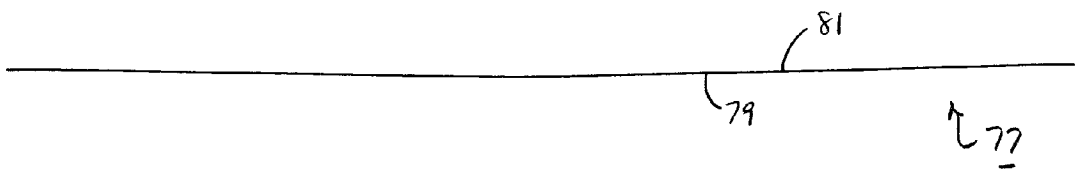
Figure 8C:
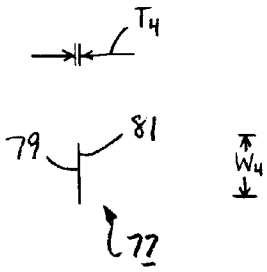

Truss strap 77, shown in isolation in FIGS. 8(*a*)-(*c*), is constructed as a thin, elongated, rectangular band of grade 50 steel that is slightly inwardly bowed and includes an inner surface 79, an outer surface 81, a narrow flattened front end 83, a narrow flattened rear end 85 and a narrow flattened intermediate section 87 located between ends 83 and 85. As will be described further below, truss strap 77 is coupled to inner surface 39 of skin plate 29 at selected points of contact and extends horizontally in a longitudinal relation relative thereto, strap 77 having a length $L_4$ of approximately 232.04 inches, a width $W_4$ of approximately 12.75 inches, and a thickness $T_4$ of approximately 0.125 inches.

Specifically, as seen most clearly in FIG. 7, truss strap 77 fittingly extends transversely though slots 71 in central vertical member 35, with outer surface 81 of strap 77 welded, or otherwise affixed, to inner surface 39 of skin plate 29 at each of ends 83 and 85. Intermediate section 87 is positioned within central vertical member 35, the location of slots 71 thereby spacing intermediate section 87 of curved truss strap 77 approximately 5.0 inches in from inner surface 39 of skin plate 29.

Due to its construction, design, curvature and selected points of connection, truss strap 77 is able to absorb inward lateral forces applied to outer surface 41 of skin plate 29. More specifically, truss strap 77 converts lateral forces applied to outer surface 41 of skin plate 29 (e.g., force F) into tensile forces (i.e., a stretch or pulling force applied along the length of strap 77).

As noted above, front and rear ends 83 and 85 are secured to inner surface 39 of skin plate 29. In addition, front and rear end post back plates 89-1 and 89-2 are affixed to inner surface 39 of skin plate 29 over front and rear ends 83 and 85, respectively, of truss strap 77. Each back plate 89 is in the form of a flattened, rectangular, metal strip that extends in a vertical orientation.

Front and rear vertical end members 37-1 and 37-2 are welded to inner surface 39 of skin plate 29 over back plates 89-1 and 89-2 in alignment therewith. As can be seen, each end member 37 is represented as a unitary component that is preferably formed from a blank constructed out of 50 grade steel. Member 37 has an elongated tubular configuration that is generally U-shaped in transverse cross-section and includes a flattened base 91, an angled bottom wall 93 and a pair of upstanding sidewalls 95-1 and 95-2.

Base 91 of each end member 37 includes upper and lower openings 97-1 and 97-2, each opening being generally circular in shape with a diameter of approximately 4.03 inches. As will be described further below, each opening 97 is dimensioned to fittingly receive a cylindrical collar that is adapted for insertion into one hollowed end of a corresponding separation member 15. A plurality of thin, rectangular collar reinforcement tabs 99 are horizontally disposed between each vertical end member 37 and its corresponding back plate 89, tabs 99 being positioned about the top and bottom edges of each opening 97 in order to provide structural support for each collar inserted therethrough.

Figure 9:
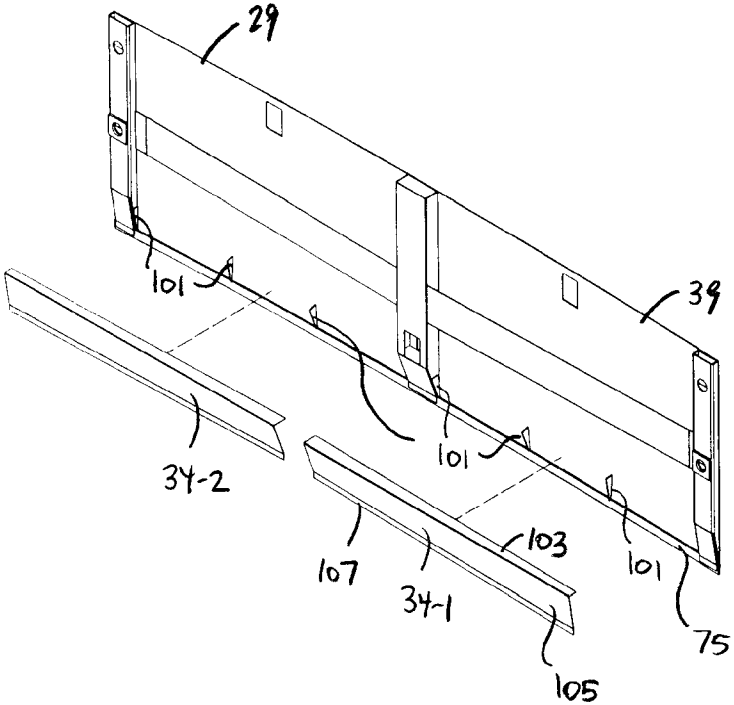
FIG. 9 is a partially exploded, left end perspective view of the skin plate, center vertical member, vertical end members, cutting bar, truss strap, cutting edge stiffeners and bottom horizontal members for the support panel shown in FIG. 2(*a*)

Referring now to FIG. 9, a plurality of triangular, or generally wedge-shaped, cutting edge stiffeners 101 are welded to inner surface 39 of skin plate 29 directly above cutting bar 75. Lower horizontal members 34-1 and 34-2 are similarly welded to inner surface 39 of skin plate 29 directly above cutting bar 75. As can be seen, each member 34 is mounted over a pair of stiffeners 101, each stiffener 101 being dimensioned to provide strength and rigidity to its corresponding member 34.

Figure 10:
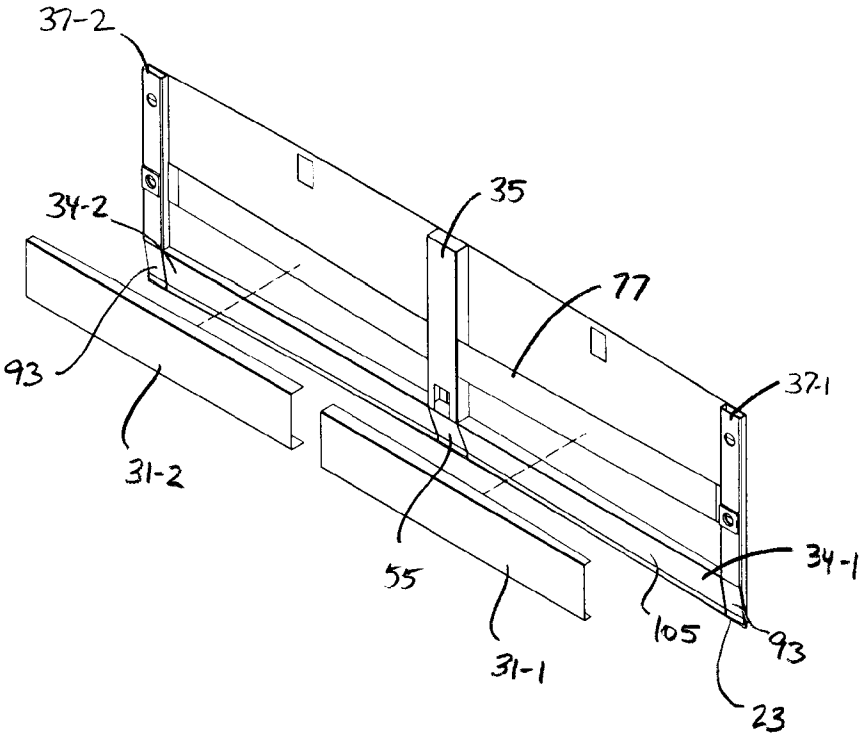
FIG. 10 is a partially exploded, left end perspective view of the skin plate, center vertical member, vertical end members, cutting bar, truss strap, bottom horizontal members, and center horizontal members for the support panel shown in FIG. 2(*a*)

It should be noted that each lower member 34 has a generally horizontal top section 103, an angled midsection 105 and a near vertical lower section 107. Referring now to FIG. 10, midsection 105 of each lower member 34 extends at the same approximate angle as angled bottom wall 55 of center vertical member 35 and angled bottom wall 93 of each vertical end member 37. Accordingly, bottom wall 23 tapers along its length into a thin, narrow vertical edge that is suitably sharpened to allow for ease in cutting through soil.

Center horizontal member 31-1 is welded to inner surface 39 of skin plate 29 directly over the portion of truss strap 77 between center vertical member 35 and front vertical end member 37-1. Similarly, center horizontal member 31-2 is welded to inner surface 39 of skin plate 29 directly over the portion of truss strap 77 between center vertical member 35 and rear vertical end member 37-1.

Each center horizontal member 31 is preferably a unitary component that is formed from a blank constructed out of 50 grade steel. Each member 31 is elongated and has a uniform, generally C-shape in transverse cross-section. As can be appreciated, each horizontal member 31 serves not only as a cover for a section of truss strap 77 but also as a structural component for providing strength and rigidity to panel 13 without considerably increasing its overall weight, which is highly desirable.

Figure 11:
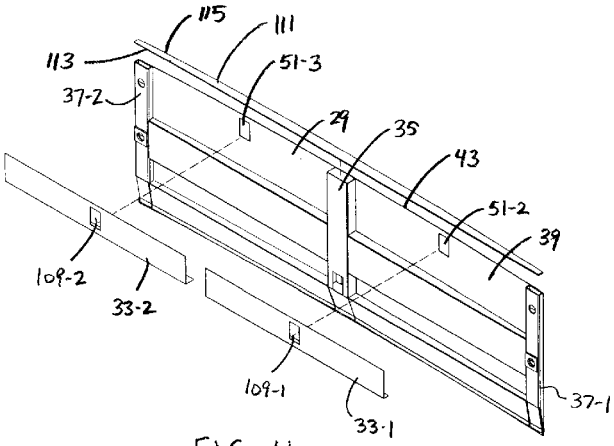
FIG. 11 is a partially exploded, left end perspective view of the skin plate, center vertical member, vertical end members, cutting bar, bottom horizontal members, center horizontal members, top horizontal members, and top plate for the support panel shown in FIG. 2(*a*)

Referring now to FIG. 11, top horizontal member 33-1 is welded to inner surface 39 of skin plate 29 along top edge 43 between center vertical member 35 and front vertical end member 37-1. Similarly, top horizontal member 33-2 is welded to inner surface 39 of skin plate 29 along top edge 43 between center vertical member 35 and rear vertical end member 37-2.

Each horizontal member 33 is preferably a unitary component that is formed from a blank constructed out of 50 grade steel. Each member 33 is elongated and has a uniform, L-shape in transverse cross-section. Horizontal members 33-1 and 33-2 are additionally shaped to define central rectangular openings 109-1 and 109-2, respectively. As can be seen, openings 109-1 and 109-2 are dimensioned and positioned to directly align and match the footprint of openings 51-2 and 51-3, respectively, in skin plate 29 for reasons to become apparent below.

A thin longitudinal top plate 111 of 50 grade steel is affixed to skin plate 29 along the entirety of top edge 43, with top plate 111 extending across and being welded to the open top end of each of center vertical member 35 and vertical end members 37-1 and 37-2. As can be seen, top plate 111 includes an inner edge 113 that is straight and extends the length of panel 13 (i.e., approximately 240 inches) and an outer edge 115 that is curved to match the radial profile of skin plate 29 (i.e., a radius of approximately 2874.205 inches).

Figure 12:
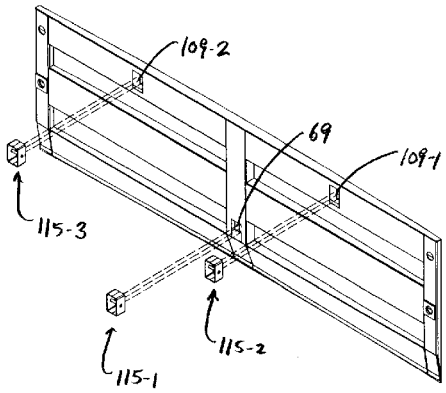
FIG. 12 is a left end perspective view of the support panel shown in FIG. 2(*a*), the support panel being shown without its collars and with its lift boxes exploded therefrom for ease of illustration.
Figure 13:
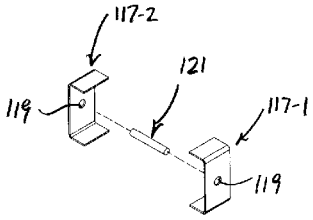
FIG. 13 is an exploded, left end perspective view of one of the lift boxes shown in FIG. 12.

Referring now to FIG. 12, lift boxes 115-1, 115-2 and 115-3 are fittingly disposed within openings 69, 109-1 and 109-2, respectively. In use, lift boxes 115 serve as convenient means for handling panel 13. As seen most clearly in FIG. 13, each lift box 115 includes a pair of opposing, C-shaped brackets 117-1 and 117-2 that are arranged as mirror reflections of one another and affixed together to create an open, box-shaped member. Each bracket 117 is shaped to define a circular opening 119 that is dimensioned to fittingly receive one end of a transverse, generally cylindrical lift bar 121. In this capacity, lift bar 121 serves as a support rod onto which machinery for handling panel 13 can be coupled.

Figure 14A:
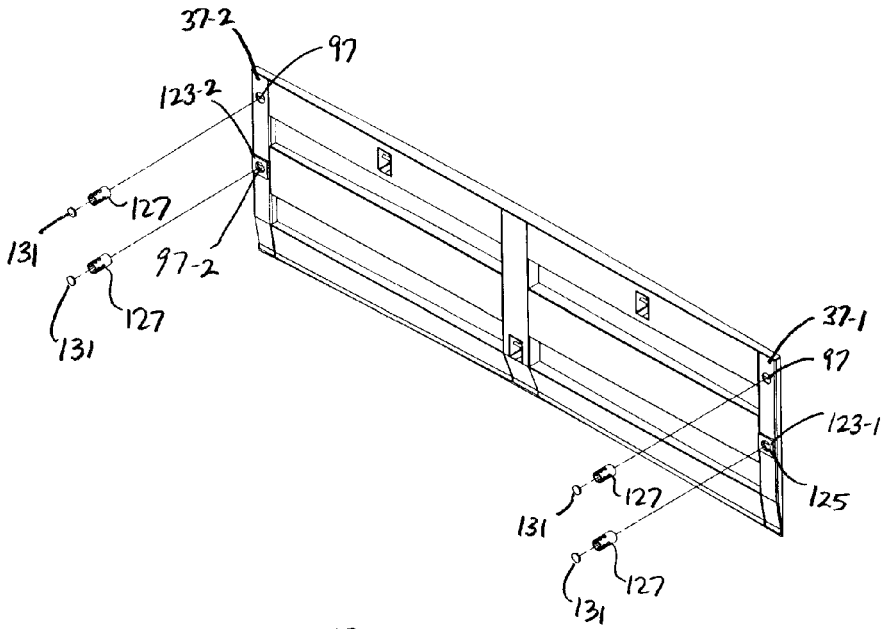
FIG. 14(*a*) is an exploded, left end perspective view of the support panel shown in FIG. 2(*a*), the support panel being shown with its collars and reinforcement discs exploded therefrom for ease of illustration.
Figure 14B:
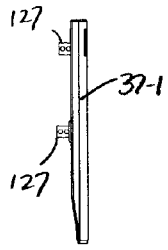
Figure 14C:
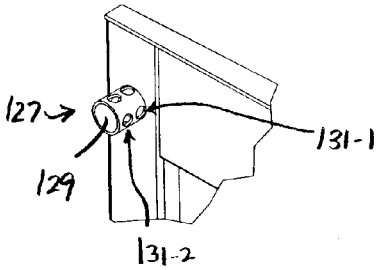

Referring now to FIGS. 14(*a*)-(*b*), a pair of small, square-shaped plates 123-1 and 123-2 is mounted onto vertical end members 37-1 and 37-2, respectively. Each plate 123 has a thickness of approximately 0.75 inches and is shaped to define a transverse opening 125 that dimensioned and positioned to directly align with lower opening 97-2 in each vertical member 37.

As referenced briefly above, each hollow cylindrical collar 127 is fittingly disposed into each opening 97 in vertical end members 37, each collar 127 being dimensioned for fitted insertion into a corresponding hollowed end of a separation member 15. Each collar 127 is shaped to define a central longitudinal bore 129 into which a reinforcement disc 131 is fittingly disposed to enhance structural rigidity and strength.

Figure 15B:
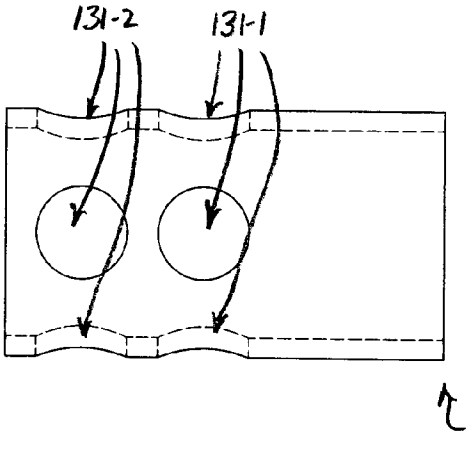
FIG. 15(*a*) is an enlarged, left end view of one of the collars shown in FIG. 14(*a*)
Figure 15C:
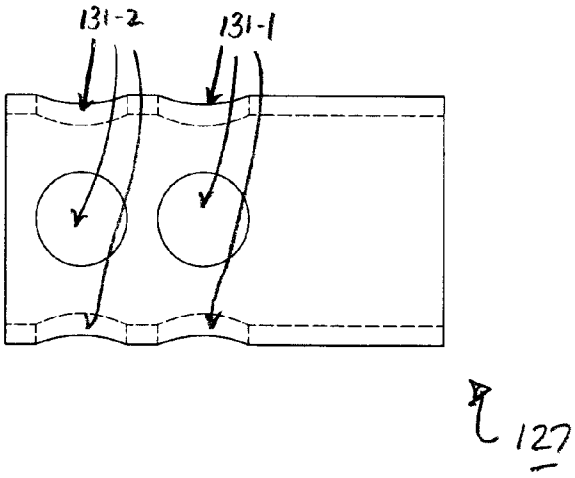
Figure 15A:
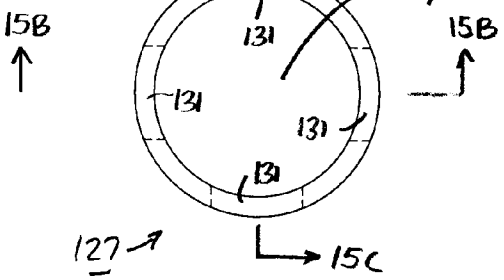

Each collar 127, shown in isolation in FIGS. 15(*a*)-(*c*), is shaped to define an inner set of four circular openings 131-1 and an outer set of four circular openings 131-2, each opening 131 extending transversely through collar 127 and into communication with longitudinal bore 129. As can be seen, inner and outer sets of circular openings 131-1 and 131-2 are disposed at different points along the length of each collar 127 to allow for adjustability in the spacing between panels 13 achieved by each separation member 15, as will be described further below. Although not shown herein, it is to be understood that additional sets of circular openings could be provided along the length of each collar 127 to allow for even further adjustability.

As seen most clearly in FIG. 15(*a*), each set of four openings 131 is arranged at 90 degree intervals about the longitudinal axis. In this manner, opposing pairs of openings are provided to receive a complementary linear fastening element 133 that can be inserted in either a generally horizontal or vertical orientation, as seen most clearly in FIGS. 1(*a*)-(*d*). In the present embodiment, fastening element 133 is represented as being the in the form of a linear pin and a complementary nut. However, it is to be understood that alternative types of conventional fastening elements could be used in place thereof without departing from the spirit of the present invention.

As shown in FIGS. 1(*a*)-(*d*), each separation member 15 is preferably constructed as a hollow cylindrical tube of a fixed length that includes a first end 135-1 and a second end 135-2. Each end 135 is dimensioned to fittingly receive a corresponding collar 127 in a coaxial relationship relative thereto. In this manner, members 15 serve to separate panels 13-1 and 13-2 in a particular orientation and at a defined spacing which can be adjusted, as will be described further below.

Each end 135 of separation member 15 includes a set of four circular transverse openings 137 that are arranged at 90 degree intervals. By aligning openings 137 in each end 135 of separation member 15 with either inner set of openings 131-1 or outer set of openings 131-2 in corresponding collar 127 and, in turn, driving a fastening element 133 therethrough, separation member 15 is fixedly secured to collar 127.

Figure 16A:
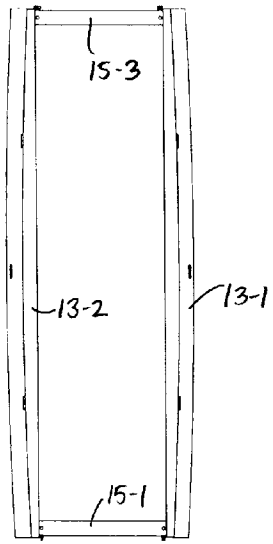
FIGS. 16(*a*)-(*b*) are top and front views of the device shown in FIG. 1(*a*), the device being configured in its drive mode.
Figure 16B:
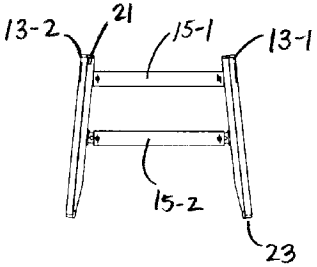

As noted above, inner and outer sets of openings 131-1 and 131-2 are disposed at distinct points along the length of collar 127 and thereby provide means for adjusting the width between panels 13 through each separation member 15. Specifically, referring now to FIGS. 16(*a*) and 16(*b*), by aligning openings 137 in upper separation members 15-1 and 15-3 with inner set of openings 131-1 in its corresponding collars 127 and, in addition, aligning openings 137 in lower separation members 15-2 and 15-4 with outer set of openings 131-2 in its corresponding collars 127, device 11 is optimally configured for its drive mode. As seen most clearly in FIG. 16(*b*), panels 13-1 and 13-2 are spaced further apart between bottom walls 23 than top walls 21. As can be appreciated, the outward flair of panels 13-1 and 13-2 in the downward position limits the frictional forces applied to device 11 when being driving vertically downward into the trench during the drive mode. In particular, contact with the soil (and the frictional forces resulting therefrom) is limited to the widened bottom walls 23 of panels 13, with the remaining exposed surface area of panels 13 being set in from the trench walls. Because frictional forces applied to panels 13 by the soil is limited primarily to bottom walls 23, device 11 can be driven vertically into place with limited force, which is highly desirable.

Figure 17A:
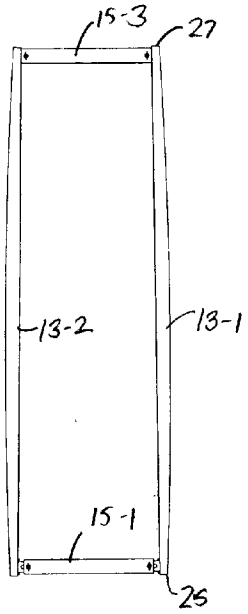
FIGS. 17(*a*)-(*b*) are top and front views of the device shown in FIG. 1(*a*), the device being configured in its slide mode.
Figure 17B:
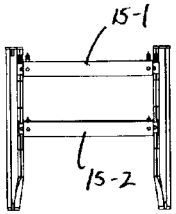

Referring now to FIGS. 17(*a*) and 17(*b*), by aligning openings 137 in front separation members 15-1 and 15-2 with outer set of openings 131-2 in its corresponding collars 127 and, in addition, aligning openings 137 in rear separation members 15-3 and 15-4 with inner set of openings 131-1 in its corresponding collars 127, device 11 is optimally configured for its slide mode. As seen most clearly in FIG. 17(*a*), panels 13-1 and 13-2 are spaced further apart between front end walls 25 than rear end walls 27. As can be appreciated, the inner rearward flair of panels 13-1 and 13-2 limits the frictional forces applied to device 11 when being slid longitudinally through a trench during its slide mode. In particular, contact with the soil (and the frictional forces resulting therefrom) is limited to the widened front end walls 25 of panels 13, with the remaining exposed surface area of panels 13 being set in from the trench walls. Because frictional forces applied to panels 13 by the soil is limited primarily to front end walls 25, device 11 can be slid forward within a trench with limited force, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for supporting the walls of an excavation, the device comprising:

(a) first and second opposing support panels that are spaced apart from one another, each of the first and second support panels having an exterior wall, an interior wall, a top wall, a bottom wall, a front end wall and a rear end wall, the exterior wall curving radially outward in the direction from the front end wall to the rear end wall, the front end walls of the first and second opposing support panels being spaced apart from one another a first distance and the rear end walls of the first and second opposing support panels being spaced apart from one another a second distance, the first distance being greater than the second distance; and (b) a separation member extending laterally between the first and second support panels, the separation member having a first end and a second end;

(c) wherein the first support panel comprises a truss strap coupled to the interior wall, whereby radial forces applied to the exterior wall of the first support panel are converted into tensile forces applied to the truss strap, the truss strap being inwardly bowed in the absence of radial forces applied to the exterior wall of the first support panel.

2. The device as claimed in claim 1 wherein the truss strap includes a first end, a second end, and an intermediate section, the intermediate section being located between the first and second ends in a spaced apart relationship relative thereto.

3. The device as claimed in claim 2 wherein the first support panel further comprises a skin plate, the skin plate having an inner surface, an outer surface, a top edge, a bottom edge, a front edge and a rear edge.

4. The device as claimed in claim 3 wherein the truss strap extends longitudinally in relationship to the skin plate, the first and second ends of the truss strap being directly secured to the inner surface of the skin plate, the intermediate section of the truss strap being spaced away from the inner surface of the skin plate so as to impart an inward bow in the truss strap.

5. The device as claimed in claim 4 wherein the first support panel further comprises a vertical member mounted to the inner surface of the skin plate, the vertical member spacing the intermediate section of the truss strap away from the inner surface of the skin plate.

6. The device as claimed in claim 5 wherein the vertical member comprises a base and a pair of upstanding sidewalls, each of the pair of upstanding sidewalls being secured to the inner surface of the skin plate, each of the pair of upstanding sidewalls being shaped to define a slot that is adapted to fittingly receive the intermediate section of the truss strap.

7. The device as claimed in claim 6 wherein the first support panel further comprises at least one horizontal member secured to the interior surface of the skin plate over the truss strap.

8. The device as claimed in claim 1 wherein the first support panel further comprises a collar, the collar extending orthogonally out from the interior wall and adapted for connection with one end of the separation member.

9. The device as claimed in claim 8 wherein the collar is shaped to define first and second transverse openings at distinct points.

10. The device as claimed in claim 9 wherein the first end of the separation member is shaped to define an opening, wherein the separation member is adapted for displacement relative to the collar so that the opening in the separation member selectively aligns with each of the first and second openings in the collar so as to provide spacing adjustability between the first and second support panels.

* * * * *